US007969368B2

(12) United States Patent
Marrocco et al.

(10) Patent No.: US 7,969,368 B2
(45) Date of Patent: Jun. 28, 2011

(54) WIDEBAND STRUCTURAL ANTENNA OPERATING IN THE HF RANGE, PARTICULARLY FOR NAVAL INSTALLATIONS

(75) Inventors: Gaetano Marrocco, Montecompatri (IT); Fernando Bardati, Rome (IT); Manlio Proia, Rome (IT); Piero Tognolatti, Rome (IT); Lorenzo Mattioni, Rome (IT); Raffaele Perelli, Ardea (IT); Giampiero Colasanti, Rome (IT); Giovanni Falcione, Rome (IT)

(73) Assignee: Selex Communications S.p.A., Genoa (IT)

( * ) Notice: Subject to any disclaimer, the term of this patent is extended or adjusted under 35 U.S.C. 154(b) by 199 days.

(21) Appl. No.: 11/917,756

(22) PCT Filed: Jun. 12, 2006

(86) PCT No.: PCT/IB2006/051863

§ 371 (c)(1), (2), (4) Date: Dec. 14, 2007

(87) PCT Pub. No.: WO2006/134543

PCT Pub. Date: Dec. 21, 2006

(65) Prior Publication Data

US 2008/0316125 A1 Dec. 25, 2008

(30) Foreign Application Priority Data

Jun. 15, 2005 (IT) ..... TO2005A0417

(51) Int. Cl.
*H01Q 1/34* (2006.01)

(52) U.S. Cl. ..... 343/709; 343/866

(58) Field of Classification Search ..... 343/900, 343/866, 867, 868, 804, 709
See application file for complete search history.

(56) References Cited

U.S. PATENT DOCUMENTS

| | | | | |
|---|---|---|---|---|
| 2,147,808 | A * | 2/1939 | Alford | 343/904 |
| 3,803,615 | A | 4/1974 | Goodbody | |
| 4,652,888 | A * | 3/1987 | Deasy | 343/791 |
| 5,014,068 | A | 5/1991 | Abramo | |
| 5,600,335 | A | 2/1997 | Abramo | |
| 6,037,905 | A * | 3/2000 | Koscica et al. | 343/701 |
| 6,600,455 | B2 * | 7/2003 | Yamamoto et al. | 343/828 |
| 6,917,339 | B2 * | 7/2005 | Li et al. | 343/702 |
| 7,187,335 | B2 * | 3/2007 | Vincent | 343/722 |
| 7,358,911 | B2 * | 4/2008 | Vincent | 343/722 |
| 2003/0103011 | A1 * | 6/2003 | Rogers et al. | 343/749 |
| 2007/0132649 | A1 * | 6/2007 | Vincent | 343/749 |

OTHER PUBLICATIONS

International Search Report, mailed Nov. 15, 2006, for PCT/IB2006/051863, 2 pages.
Written Opinion, mailed Nov. 15, 2006, for PCT/IB2006/051863, 5 pages.

* cited by examiner

*Primary Examiner* — HoangAnh T Le
(74) *Attorney, Agent, or Firm* — Seed IP Law Group PLLC

(57) ABSTRACT

A structural antenna system for operation in the HF frequency range, particularly for naval communications, is described, comprising at least one linear radiating arrangement (14) adapted to be operatively associated with a ground conductor (GND) and at least one electrical impedance device (Z1-Z4), in which the aforesaid linear radiating arrangement (14) is coupled to a pre-existing naval structure which has a predominantly vertical extension and is electrically conducting, such as a funnel (F). A structural antenna system with multiple feed comprises a plurality of linear radiating arrangements (114) positioned in meridian planes of the naval structure of the funnel type (F), spaced at equal angular intervals.

20 Claims, 5 Drawing Sheets f = 2 MHz

VERTICAL PLANE

HORIZONTAL PLANE f = 3 MHz

VERTICAL PLANE

HORIZONTAL PLANE f = 5 MHz

VERTICAL PLANE

HORIZONTAL PLANE f = 15 MHz

VERTICAL PLANE

HORIZONTAL PLANE f = 25 MHz

VERTICAL PLANE

HORIZONTAL PLANE f = 30 MHz

VERTICAL PLANE

HORIZONTAL PLANE

WIDEBAND STRUCTURAL ANTENNA OPERATING IN THE HF RANGE, PARTICULARLY FOR NAVAL INSTALLATIONS

The present invention relates to a structural antenna, and in particular a wideband structural antenna for operation in the HF frequency range.

More specifically, the invention relates to an antenna system of the type referred to in the preamble of Claim 1.

In radio communication systems for naval installations, in the HF frequency range (2 MHz-30 MHz) conventionally used for naval communications, the antennae used at present must not only meet the requirement of operating in a plurality of transmission channels throughout the frequency range of the band and allow links in the proximity of the horizon (surface wave or sea wave, for distances up to approximately 100 km), beyond the horizon (BLOS, Beyond Line of Sight, for distances of more than approximately 100 km) and at high angles of elevation (NVIS, Near Vertical Incidence Skywave), but must also be as compact as possible in order to be compatible with the available space on board naval units.

Transmission systems known as "multichannel" systems have therefore been proposed for combining a plurality of transmission channels by using a single wideband antenna at the input of which a multiplicity of transmission channels are added by means of combining circuits. These multichannel systems are constructed with the aid of power amplifiers (generally of the order of 1 kW) which can be independently assigned to different services or to a single channel.

With this solution, the control of the power is critical, and specifically there is a loss of power due to the presence of the combining circuits.

By way of example, it can be pointed out that the combination of eight-channel with hybrid transformers in a single antenna results in an effective power of approximately 125 W supplied to each channel, with a peak power of 8 kW. Consequently, a multichannel system requires amplifiers providing more power by an order of magnitude than the power actually radiated, and is subject to a considerable loss of efficiency.

This problem is conventionally resolved by fitting the ship with multiple antennae, having different configurations and operating in separate frequency sub-bands, each being allocated to a specific channel.

For example, "fan" antennae are used for links with high angles of elevation at frequencies in the range from 2 MHz to 8 MHz, and antennae with "whip" geometry, loaded if necessary, are used for sea wave communications and communications beyond the horizon at frequencies in the range from 10 MHz to 30 MHz.

The coexistence of a plurality of antennae for different communication services and modes not only requires a large amount of space, complicated supply networks and elaborate control systems in a ship, but also has the drawback of generating interference (with pre-existing naval structures, for example) which can degrade the expected performance of the individual antennae.

The problem of the efficient use of the available space has been tackled for some time in aeronautical environments where structural solutions are usual, in which the whole aircraft, or part of it (such as the fuselage) is used as a radiating element by means of suitable feed procedures ("notch" or "towel-bar" antennae). However, such solutions are not found in the naval context, where the difficulty associated with the solution of electromagnetic problems for transmission in the HF band has caused communications in this band to be progressively abandoned in favour of more efficient satellite communications.

The object of the present invention is to provide a wideband multifunction antenna system for operation in the HF frequency range, which is designed particularly for fixed installations on board naval units, and which makes it possible to construct an efficient, flexible and multi-purpose multichannel radio communication system in a limited installation space.

A further object of the invention is to provide an antenna system which can form the base of a more complex antenna system, possibly one which also permits the control of the radiation pattern in terms of directionality and scanning capacity.

To this aim, the invention proposes a structural antenna system having the characteristics claimed in Claim 1.

Specific embodiments are defined in the dependent claims.

The antenna system proposed by the present invention is guaranteed to overcome the limits of prior art antennae, as a result of the special arrangement of the radiating elements of the antenna and the inclusion among these of a pre-existing naval structure having a predominantly vertical extension, providing support for the linear radiating arrangement together with intrinsic compensation of the distortion effects of the radiation characteristics of this arrangement due to the presence of the said naval structure.

The achievement of a multichannel communication mode is dependent on the provision of electrical impedance devices which create a multifunction antenna, in other words one which can be configured according to the operating frequency.

The provision of electrical impedance devices also advantageously makes it possible to compensate for distortion effects due to coupling with other naval structures present in all cases, thus enabling the loading condition of the antenna to be modified either in the design phase or during installation.

According to the reciprocity theorem, the behaviour and characteristics of an antenna remain unchanged, regardless of whether it is used as a receiving or transmitting antenna, and therefore in the present description the operation of a transmitting antenna is considered and the definition of some characteristics makes reference to this for the sake of clarity, without excluding the use of the device in reception.

Briefly, the structural antenna system proposed by the invention, in its simplest configuration, is characterized by the coupling of a linear radiating arrangement (produced by the combination of variously orientated wire elements) to a pre-existing electrically conducting naval structure having a predominantly vertical extension, such as a funnel or turret, whose height is typically comparable with that of a conventional naval "whip" antenna. Such a structure not only has the intrinsic functionality for which it is present in the naval environment, but also acts as a support for the linear radiating arrangement and as part of the antenna system itself.

Advantageously, the resulting structural antenna system is fairly compact and does not significantly increase the overall dimensions of the pre-existing structure forming part of the naval environment.

The linear radiating arrangement has a predominantly vertical overall dimension and comprises a fed conducting branch, having a predominantly vertical extension, connected by means of at least one conducting branch with a predominantly horizontal extension to the naval structure acting as a ground return conducting element, in such a way as to form at least one closed path.

A type of structure including at least one additional angled conducting branch connecting the fed branch having a vertical extension with the connecting branch having a horizontal extension makes it possible to form a plurality of current paths by convenient selection of a configuration of the radiating elements of the antenna.

The selection of one of the aforesaid configurations is automatic and dependent on the different frequency subbands of the HF range, and is carried out as a result of the behaviour of the electrical impedance devices, made at least partially in the form of lumped constant two-terminal circuits, preferably two-terminal LC circuits in series or parallel resonant configurations, which act as bandpass or bandstop filters for the current flowing in the radiating elements of the antenna.

The electrical impedance devices make it possible to selectively modify the flow of current in the conducting branches at the different frequencies (and thus in accordance with the type of service) in such a way as to form radiation patterns at low, medium and high angles of elevation, while simultaneously acting as a distributed matching circuit along the antenna.

A structural antenna system based on the radiating arrangement proposed by the invention can be configured with one or more feed points, and can operate in either single-channel or multichannel mode.

An antenna system comprising a single linear radiating arrangement, and therefore a single feed point, can be used as a multifunction wideband radiator (in the sense defined above) with a standing wave ratio of less than 3:1 throughout the HF band and with a radiation efficiency of approximately 0.5%-30% between 2 MHz and 10 MHz, approximately 30%-50% between 10 MHz and 15 MHz, and approximately 50%-80% between 15 MHz and 30 MHz.

By connecting a multiplicity of similar linear radiating arrangements to the pre-existing conducting naval structure, a multiple feed structural antenna system is produced which is adapted to operate in either multichannel or single-channel mode, with the possibility of shaping and directing the radiation pattern according to the specific type of service.

In the first case (broadcast communications), the configuration with multiple feed points (ports) makes it possible to allocate a different channel (signal) to each port, thus avoiding the use of combining circuits, and providing the evident advantages of higher efficiency of the antenna system and a lower cost of the transmission systems, while limiting the overall dimensions of the radiating arrangements.

In the second case, in multichannel mode, in other words when a plurality of feed ports are used for a single channel (signal), it becomes possible to shape (particularly to narrow) and orientate the radiation lobe to achieve a gain in terms of performance.

In particular, it becomes possible to optimize the power transmitted in non-broadcast communications, for which the radiation can be contained in a limited angular sector. Advantageously, this enables the same antenna system to be used for sea wave, ionospheric reflection and NVIS communications.

It is also possible to reduce the power delivered, and thus limit the interaction with the other structures of the ship.

Another function relates to the possibility of operating the single-channel antenna system as an array antenna with aiming and scanning capabilities, by controlling the amplitudes and phases of the feed signal to each radiating arrangement.

Advantageously, the proposed configuration is adapted to produce sufficiently uniform radiation in all directions at the low frequencies (2 MHz-10 MHz) and omnidirectional radiation in the horizontal planes at the medium and high frequencies (10 MHz-30 MHz), thus permitting simultaneous provision of all the services required in the HF band, namely sea wave, sky wave and beyond horizon communication at different angles of elevation, without the need for any mechanical modification or reconfiguration of the antenna system or of its feed circuit.

Further characteristics and advantages of the invention will be revealed more fully in the following detailed description, provided by way of example and without restrictive intent, with reference to the attached drawings, in which.

Figure 1:
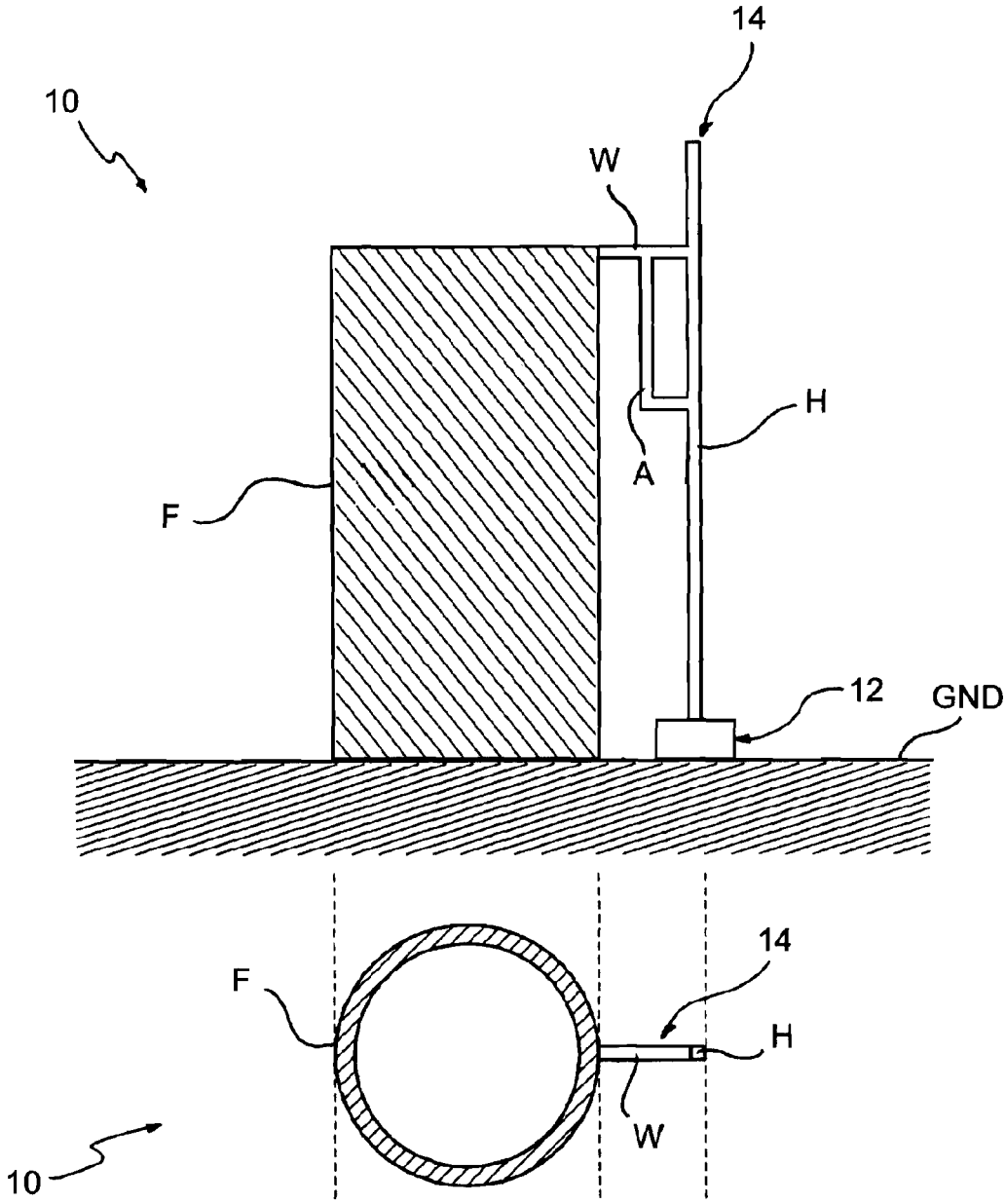
FIG. 1 is a schematic representation, in a side view and from above, of a structural antenna system proposed by the invention.
Figure 5:
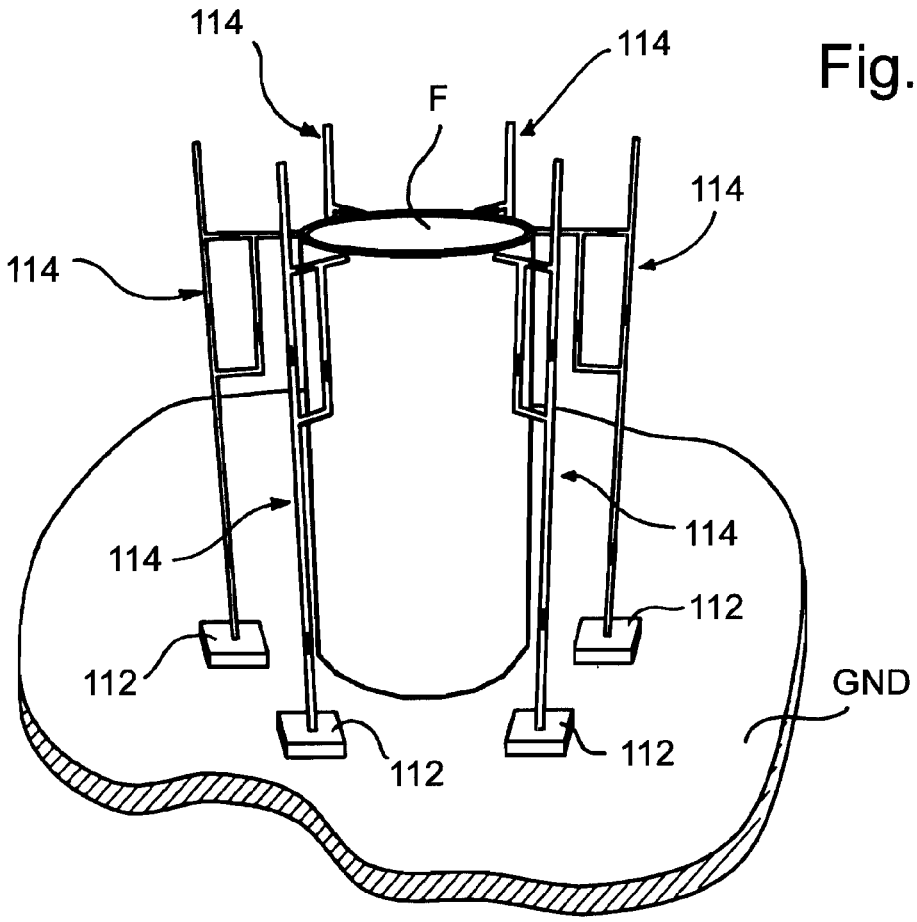
Figure 6:
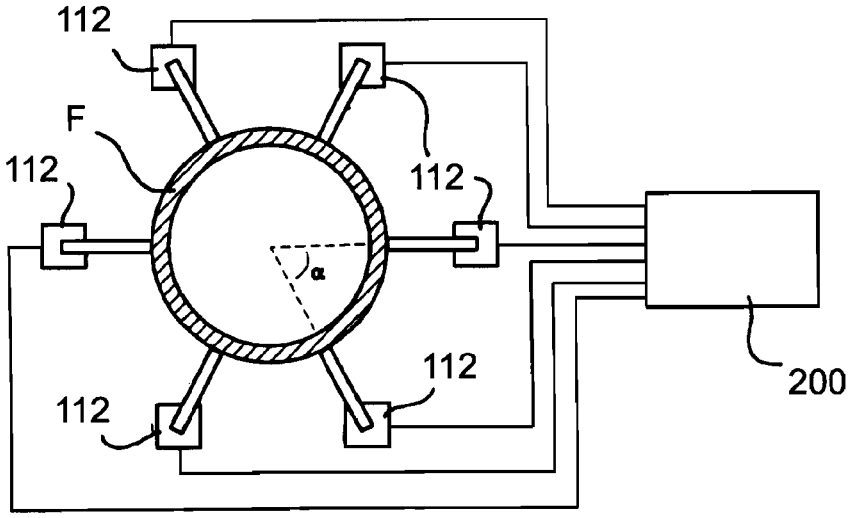

FIGS. 4*a*-4*f* are representations of the radiation patterns of the structural antenna system of FIG. 1, at different frequencies in the HF band;

FIG. 5 is a schematic representation, in a perspective view, of a structural antenna system with multiple feed proposed by the invention; and FIG. 6 shows a control system for the structural antenna system with multiple feed of FIG. 4.

A wideband multifunction structural antenna system proposed by the invention, adapted to operate in the HF frequency range (2 MHz-30 MHz), is generally indicated by 10. In FIG. 1, it is shown in an installation configuration for use as a transmitting antenna, connected to a feed unit 12 and to a ground plane GND.

As mentioned in the introductory part of this description, according to the reciprocity theorem, the behaviour and characteristics of the antenna remain unchanged regardless of whether it is used as a receiving or a transmitting antenna. Purely by way of illustration and without restrictive intent, the following part of the description will relate to the operation of a transmitting antenna system, for the sole purpose of defining in the clearest and most appropriate way the characteristics of the radio frequency signal feed circuit.

The antenna system of FIG. 1 represents a structural antenna comprising a single linear radiating arrangement 14 (and therefore having a single feed point), coupled to a pre-existing electrically conducting naval structure having a predominantly vertical extension, such as a funnel F, located in a meridian plane.

The overall configuration of the antenna system is predominantly vertical, and the linear radiating arrangement is preferably mounted on a horizontal ground plane, for example a surface of the naval structure.

The linear radiating arrangement of the antenna comprises wire radiating elements with a predominantly vertical extension and wire radiating elements with a predominantly transverse extension, all these elements being coplanar.

The radiating elements with a predominantly vertical extension form a first vertical conducting branch H connected to a terminal of the feed unit 12.

The naval structure consisting of a funnel F, having a cylindrical or truncated conical body erected on a surface of the naval structure, is made from conducting material or is made conducting by the application of a metallic coating. It forms the return conductor, being electrically connected to the ground plane GND.

The fed conducting branch H is connected to the funnel structure F by a transverse conducting branch W consisting of at least one radiating element having a predominantly horizontal extension, and forms with these latter a closed rectangular path between the feed unit and the ground plane. The transverse conducting branch W is connected to the fed branch H at an intermediate point of the branch, at a predetermined distance from the upper free end of the latter.

An angled conducting branch A is connected at its upper end to the transverse conducting branch W and at its lower end to the vertical conducting branch H, at corresponding intermediate points of the aforesaid branches, and forms a second closed polygonal path between the feed unit and the ground plane, inside the rectangular path defined by the branches H and W.

In the currently preferred embodiment, the vertical overall dimension of the linear radiating arrangement (in other words, the height of the conducting branch H) is between approximately 8% and 10% of the maximum wavelength in the HF band (150 meters at the 2 MHz frequency), and is preferably 12 meters. The height of the funnel body is generally between approximately 6% and 10% of the maximum wavelength in the HF band.

The overall horizontal dimension of the linear radiating arrangement is between approximately 1% and 2% of the maximum wavelength in the HF band (150 meters at the 2 MHz frequency), and is preferably 2 meters. The diameter of the body (which is cylindrical in the illustrated embodiment) of the funnel structure is generally between 2% and 5% of the maximum wavelength in the HF band.

The height of the angle conducting branch A is equal to approximately 2% of the maximum wavelength in the HF band, and is preferably equal to 3 meters, while its transverse extension is equal to approximately 0.7% of the aforesaid wavelength and is preferably equal to 1 meter.

The diameter of the radiating elements forming the conducting branches is approximately 0.1% of the maximum wavelength in the HF band, and preferably equal to 0.15 meters.

The naval structure such as the funnel body F is a hollow structure whose lateral wall generally has a thickness of 0.25 meters.

Conveniently, the transverse conducting branch W is connected to the vertical branch H at an intermediate point of the latter, at a distance of 2 meters from its upper free end. The angle conducting branch A is connected to the transverse conducting branch W at its median point, and to the vertical conducting branch H at a height above its median point, and preferably at 7 meters from the ground plane, corresponding to approximately 60% of the total height of the branch.

Figure 2:
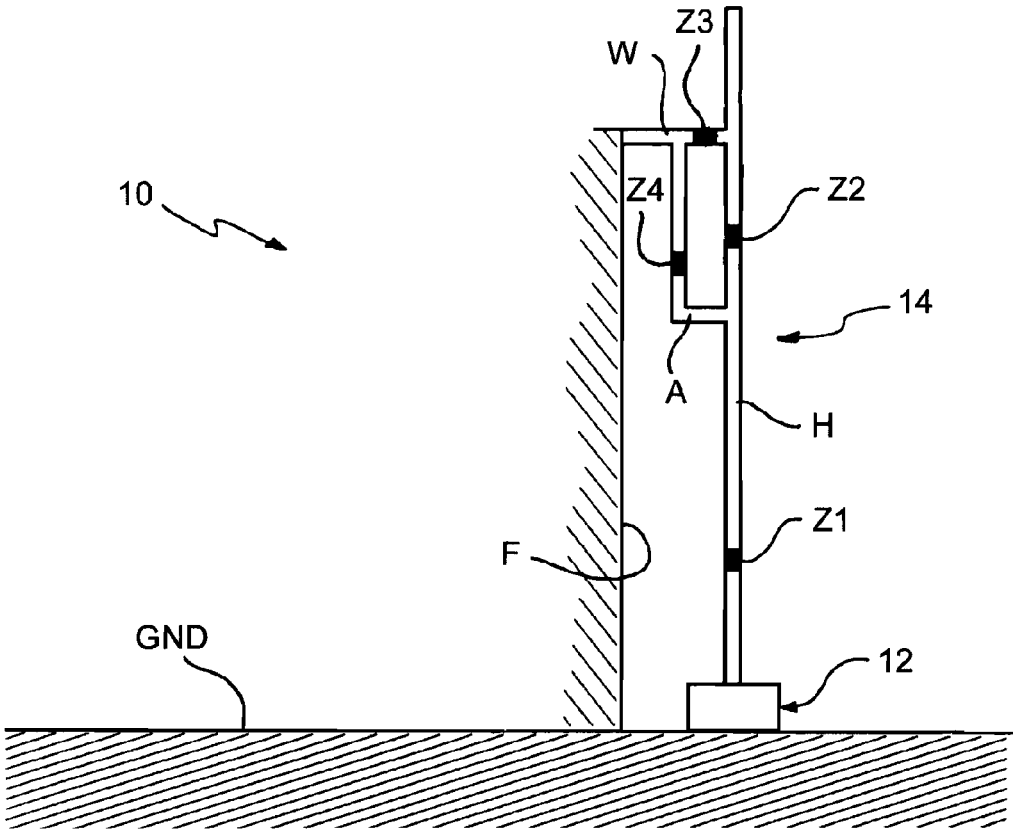
FIG. 2 is a schematic representation of the distribution of electrical impedance devices along the linear radiating arrangement of the antenna system of FIG. 1.
Figure 4A:
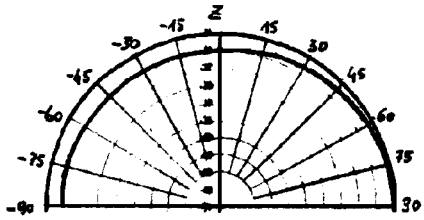
Figure 4A:
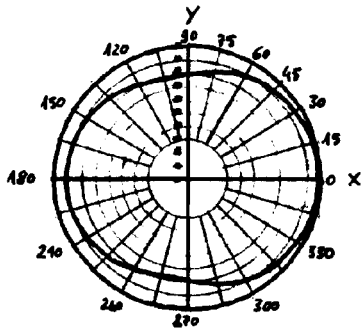
Figure 4B:
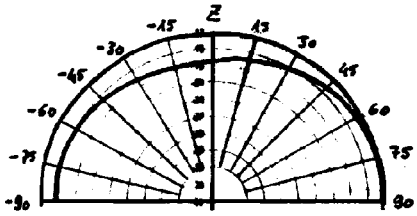
Figure 4B:
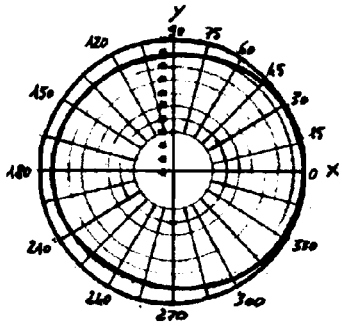
Figure 4C:
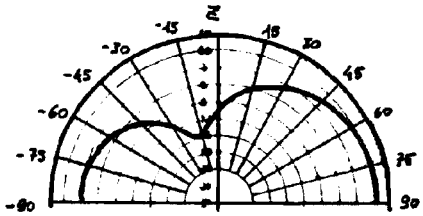
Figure 4C:
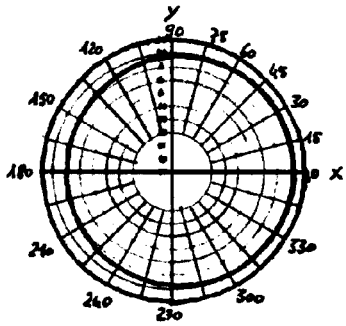
Figure 4D:
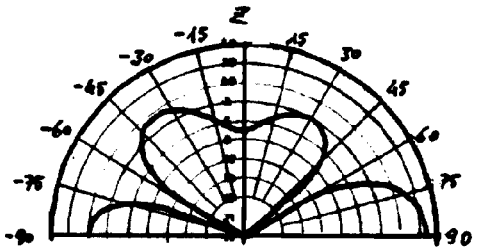
Figure 4D:
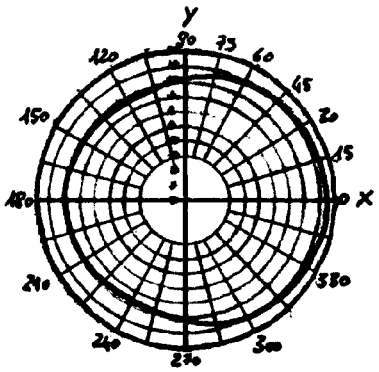
Figure 4E:
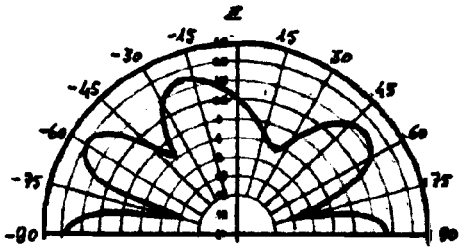
Figure 4E:
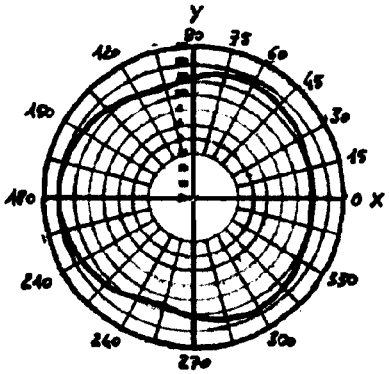
Figure 4F:
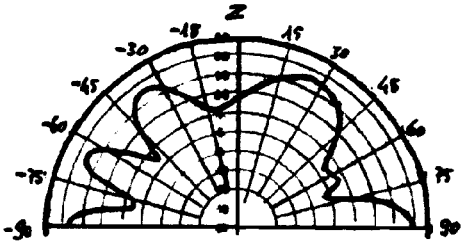
Figure 4F:
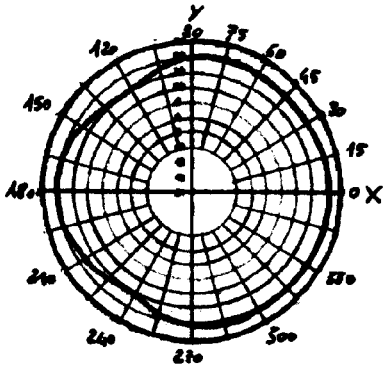

With reference to FIG. 2, electrical impedance devices Z1 and Z2 are interposed along the conducting branch H, an impedance device Z3 is interposed along the transverse conducting branch W, and a further impedance device Z4 is interposed along the angled conducting branch A, preferably along the vertical leg.

Preferably, each of the impedance devices Z1 and Z2 comprises a two-terminal reactive circuit, such as a series resonant LC circuit, while each of the impedance devices Z3 and Z4 comprises a two-terminal resistive circuit such as a simple resistor.

The electrical parameters of the impedance devices Z1 and Z2 are such that they form lumped filter circuits adapted to selectively impede the propagation of electric current along the conducting branch in which they are connected, in corresponding sub-bands of the HF frequency range.

The electrical parameters of the impedance devices Z1-Z4, taken together, are such that they form a distributed matching circuit along the linear radiating arrangement of the antenna.

In the preferred embodiment, the impedance devices Z1, Z2 and Z4 are positioned, respectively, at heights of 3.25 meters, 8.25 meters and 7.75 meters above the ground plane GND, while the impedance device Z3 is positioned at 1.25 meters from the lateral wall of the naval tunnel structure F.

In the exemplary embodiment described here, the electrical parameters of inductance and capacitance of the two-terminal series LC circuits forming the impedance devices Z1 and Z2 have the following values:

the two-terminal circuit Z1 has an inductive component of 1.12 μH and a capacitive component of 569.1 pF; and the two-terminal circuit Z2 has an inductive component of 0.073 μH and a capacitive component of 59.8 pF.

The electrical resistance parameter of the two-terminal circuit forming the impedance devices Z3 and Z4 has the following values:

the dipole Z3 has a resistive component of 48.6Ω; and the dipole Z4 has a resistive component of 61Ω.

Clearly, a person skilled in the art will be able to depart from the design data cited above which relate to the currently preferred embodiment, by providing a greater or a smaller number of impedance devices than that specified, provided that the devices are positioned along the conducting branches in such a way as to selectively control the coupling of the branches H, W and A to the funnel structure F and to the ground conductor (plane) GND by their filtering action, and more specifically in such a way as to disconnect one or more of the branches alternatively from the current path.

Figure 3:
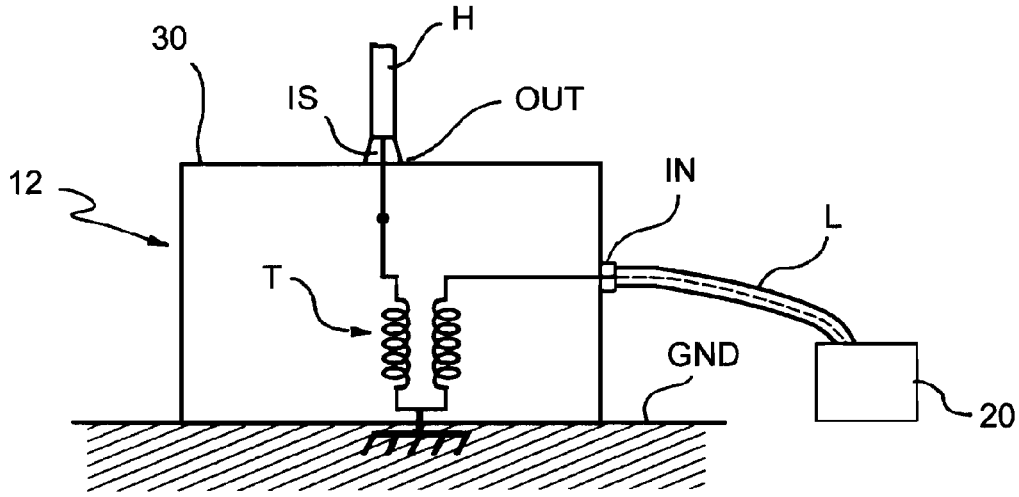
FIG. 3 is a schematic representation of a feed circuit for the antenna system of FIG. 1.

The feed unit 12 includes a signal matching and distribution circuit, such as that shown in FIG. 3.

The unit 12 is operatively arranged at the base of the linear radiating arrangement of the antenna and electrically connected between the conducting branch H and a transmission line for carrying a radio frequency signal.

With reference to a transmission configuration, the feed unit 12 has an input IN coupled to a radio frequency signal source 20 via a transmission line L, such as a coaxial cable, and an output port OUT, into which the vertical conducting branch H of the antenna is fitted with the use of an insulator IS.

The feed unit includes an impedance step-up transformer T having a predetermined impedance transformation ratio n, preferably equal to 3.7, referred to ground, having one terminal connected to the input IN for receiving the radio frequency signal, and the other terminal connected to the output port OUT.

The feed unit which has been described can be enclosed in a boxlike metal container 30, forming an electrical screen and connected to the ground plane GND. This forms a 50 ohm matching unit for the incoming transmission line.

In terms of operation, the antenna system proposed by the invention acts as described below.

For better comprehension, FIGS. 4*a*-4*f* show the radiation patterns at different frequencies, in the vertical (left-hand pattern) and horizontal (right-hand pattern) planes.

A radio frequency signal, output by the external source 20 and carried along the transmission line L, is applied to the impedance transformer T and is transferred to the output OUT of the feed unit 12, connected to the conducting branch H of the antenna. From this point, it is distributed along the linear radiating arrangement and the funnel structure in a selective way according to the frequency and therefore the type of function required from the antenna, depending upon the configuration of the linear arrangement determined by the behaviour of the impedance devices.

At low frequencies, between 2 MHz and 10 MHz, the impedance device Z2 comes into action to impede the flow of current in the upper portion of the fed branch H, so that the current in the linear arrangement flows through the lower portion of the conducting branch H, the inner path along the angled conducting branch A and the portion of the conducting branch W adjacent to the funnel structure. The antenna system thus has a radiation mode similar to that which would be provided by a combination of the radiation of a "half-loop" configuration and the radiation of a "whip" configuration. The resulting radiation pattern (the radiation patterns of FIGS. 4*a*-4*c*) is substantially uniform in all directions, thus permitting sea wave and sky wave communications at different angles of elevation.

At medium and high frequencies, between 10 MHz and 30 MHz, no impedance device impedes the flow of current, and the current tends to flow through all the wire radiating elements, including, in particular, the upper portion of the vertical fed conducting branch H, up to the free end. The configuration of the linear arrangement and the radiation mode of the corresponding antenna system (radiation patterns in FIGS. 4*d*-4*f*) are therefore similar to those of a whip antenna, which has an omnidirectional radiation pattern in the horizontal plane, at low and medium angles of elevation, and is suitable for sea wave and BLOS communications.

With reference to the antenna system shown in FIGS. 5 and 6, what is described is a structural antenna system with multiple feed, comprising a plurality of linear radiating arrangements 114 having geometries and characteristics similar to those of the arrangement 14 described with respect to the embodiment shown in FIG. 1, which relates to a structural antenna system with a single feed.

Each linear radiating arrangement 114 is connected to a corresponding feed unit 112, similar to the unit 12 described, and is coupled to a pre-existing electrically conducting naval structure, having a predominantly vertical extension, such as a funnel F forming a return conductor electrically connected to a horizontal ground plane GND, for example a surface of the naval structure.

In the currently preferred embodiment, there are provided six identical radiating arrangements 114, positioned in meridian planes of the said naval structure and spaced at equal angular intervals of 60 degrees.

A control and signal processing unit 200 is connected to the feed units 112 and is arranged to control the amplitude and phase of the radio frequency currents injected into the linear radiating arrangements 114 from the signal source through the corresponding feed units 112.

The currents are distributed along the conducting branches and the cylindrical conducting body of the funnel structure according to the frequency and the amplitudes and phases of the radio frequency signals. Depending on the function required from the antenna, the six feed points can be fed simultaneously or with a predetermined phase difference, and partially if necessary, thus providing omnidirectional multichannel radiation configurations or directive configurations with scanning capability, by addition of the radiated fields in the air.

It should be noted that the embodiment of the present invention proposed in the preceding discussion is purely exemplary and is not restrictive. A person skilled in the art could easily apply the present invention in different embodiments based on the principle of the invention. This is particularly true as regards the possibility of positioning the fed conducting branch and/or the transverse conducting branch for connection to the naval structure in an inclined direction, or making the transverse connecting branch and the angled branch from non-rectilinear wire elements, such as curved elements, to obtain an increased mechanical stability of the structure of the antenna, or again the possibility of coupling the linear radiating arrangement to a naval structure other than a funnel, for example a turret equipped for the installation of antennae operating at higher frequencies.

Clearly, provided that the principle of the invention is retained, the forms of application and the details of construction can therefore be varied widely from what has been described and illustrated purely by way of example and without restrictive intent, without departure from the scope of protection of the present invention as defined by the attached claims.

The invention claimed is:

1. Antenna system for operation in the HF frequency range, comprising a linear radiating arrangement configured to be electrically coupled with a ground conductor and at least one electrical impedance device when in use, and wherein said linear radiating arrangement having a predominately vertical dimension and which is electrically coupled in use to a naval structure which has a predominantly vertical extension, is electrically conducting and which forms an active radiating element of the antenna system, said linear radiating arrangement comprising at least a fed conducing branch and at least one horizontal contacting branch which electrically connects the feed conducting branch to the navel structure as a ground return conducting element.

2. Antenna system according to claim 1, in which said naval structure is a structure of substantially cylindrical or truncated conical shape.

3. Antenna system according to claim 2, in which said structure is a funnel of a ship.

4. Antenna system according to claim 1, in which a vertical extension of the linear radiating arrangement is between 8% and 10% of the maximum wavelength in the HF band.

5. Antenna system according to claim 1, in which a transverse extension of the linear radiating arrangement is between 1% and 2% of the maximum wavelength in the HF band.

6. Antenna system, for operation in the HF frequency range, comprising a linear radiating arrangement configured to be electrically coupled with a ground conductor and at least one electrical impedance device when in use, and wherein said linear radiating arrangement is electrically coupled in use to a naval structure which has a predominantly vertical extension, is electrically conducting and which forms a radiating element of the antenna system, and said linear arrangement includes:

a plurality of wire radiating elements having a predominantly vertical extension, forming a first conducting branch configured to be electrically coupled to a radio frequency signal feed circuit; and a plurality of wire radiating elements having a predominantly horizontal extension, forming at least one transverse conducting branch, for connecting the first conducting branch adapted to be coupled to the feed circuit, to the said naval structure, said radiating elements being arranged in such a way as to form at least one closed path between the feed circuit and the ground conductor through said naval structure, and a plurality of electrical impedance devices interposed along the conducting branches and adapted to create selectively, according to the operating frequency, a plurality of different current paths along said conducting branches corresponding to a plurality of different electrical and/or geometrical configurations of the aforesaid radiating arrangement.

7. Antenna system according to claim 6, in which said transverse conducting branch is connected to a fed conducting branch at an intermediate point of said fed conducting branch, at a predetermined distance from an upper free end thereof.

8. Antenna system according to claim 6, in which said transverse conducting branch and a fed conducting branch are additionally connected to each other through an angled conducting branch.

9. Antenna according to claim 8, in which said angled conducting branch comprises a first portion extending in the horizontal direction and a second portion extending in the vertical direction.

10. Antenna system according to claim 6, in which said conducting branches form, in an operating arrangement of the antenna system, a vertical plane in which the antenna system lies, coinciding with a meridian plane of said naval structure.

11. Antenna system according to claim 6, in which said electrical impedance devices comprise two-terminal reactive circuits with lumped parameters and two-terminal resistive circuits.

12. Antenna system according to claim 11, in which said two-terminal reactive circuits comprise series resonant LC circuits.

13. Antenna system according to claim 11, comprising impedance devices arranged on the fed conducting branch, having electrical parameters such that they form:

a current path comprising a portion of the fed conducting branch, the angled conducting branch and a portion of the transverse conducting branch, so that the antenna system has an overall radiation pattern in the form of a combination of the radiation pattern of a "half-loop" configuration and that of a "whip" configuration, in a first frequency range, and a plurality of current paths comprising the whole fed conducting branch, the angled conducting branch and the whole transverse conducting branch, so that the antenna system has a radiation pattern of a whip configuration, in a second frequency range.

14. Antenna system according to claim 11, in which the impedance devices are designed to form a distributed impedance matching circuit for each configuration of the linear radiating arrangement.

15. Antenna system according to claim 6, including a radio frequency signal matching and distribution unit coupled to said first conducting branch having a predominantly vertical extension of the radiating arrangement, which includes an impedance step-up transformer circuit referred to the ground conductor, this circuit having a first terminal coupled to a signal transmission line and a second terminal coupled to said first conducting branch.

16. Antenna system according to claim 6, comprising a plurality of linear radiating arrangements coupled to said naval structure, in such a way as to form an antenna system with multiple feed.

17. Antenna system according to claim 16, in which said linear radiating arrangements are positioned in meridian planes of said naval structure and are spaced at equal angular intervals.

18. Antenna system according to claim 16, comprising a control and signal processing unit connected to corresponding feed units of said linear radiating arrangements, the control and signal processing unit being arranged to control the amplitudes and phases of the injected radio frequency currents for the wire radiating elements forming said radiating arrangements.

19. Antenna system according to claim 6, in which said naval structure is a structure of substantially cylindrical or truncated conical shape.

20. Antenna system according to claim 19, in which said structure is a funnel of a ship.

* * * * *

UNITED STATES PATENT AND TRADEMARK OFFICE

CERTIFICATE OF CORRECTION

PATENT NO. : 7,969,368 B2
APPLICATION NO. : 11/917756
DATED : June 28, 2011
INVENTOR(S) : Gaetano Marrocco et al.

It is certified that error appears in the above-identified patent and that said Letters Patent is hereby corrected as shown below:

Title page, Item 75:
"Gaetano Marrocco, Montecompatri (IT); Fernando Bardati, Rome (IT); Manlio Proia, Rome (IT); Piero Tognolatti, Rome (IT); Lorenzo Mattioni, Rome (IT); Raffaele Perelli, Ardea (IT); Giampiero Colasanti, Rome (IT); Giovanni Falcione, Rome (IT)" should read, --Gaetano Marrocco, Montecompatri Roma (IT); Fernando Bardati, Roma (IT); Manlio Proia, Roma (IT); Piero Tognolatti, Roma (IT); Lorenzo Mattioni, Roma (IT); Raffaele Perelli, Ardea Roma (IT); Giampiero Colasanti, Roma (IT); Giovanni Falcione, Roma (IT)--.

Title page, Item 73, Assignee:
"Selex Communications S.p.A., Genoa (IT)" should read, --Selex Communications S.p.A., Genova (IT)--.

Signed and Sealed this
Twenty-second Day of November, 2011

David J. Kappos

David J. Kappos
*Director of the United States Patent and Trademark Office*